US010583488B2

(12) United States Patent
Kikkawa et al.

(10) Patent No.: US 10,583,488 B2
(45) Date of Patent: Mar. 10, 2020

(54) MANUFACTURING METHOD FOR MAGNETIC FREEZING MODULE

(71) Applicant: SANTOKU CORPORATION, Kobe-shi, Hyogo (JP)

(72) Inventors: Takehiko Kikkawa, Kobe (JP); Hiroaki Takata, Kobe (JP)

(73) Assignee: SANTOKU CORPORATION, Kobe-shi, Hyogo (JP)

( * ) Notice: Subject to any disclaimer, the term of this patent is extended or adjusted under 35 U.S.C. 154(b) by 167 days.

(21) Appl. No.: 15/555,614

(22) PCT Filed: Mar. 4, 2016

(86) PCT No.: PCT/JP2016/056847
§ 371 (c)(1),
(2) Date: Sep. 5, 2017

(87) PCT Pub. No.: WO2016/140350
PCT Pub. Date: Sep. 9, 2016

(65) Prior Publication Data

US 2018/0043435 A1 Feb. 15, 2018

(30) Foreign Application Priority Data

Mar. 5, 2015 (JP) ..... 2015-060129

(51) Int. Cl.

| | |
|---|---|
| ***B22F 3/24*** | (2006.01) |
| ***C22C 38/04*** | (2006.01) |
| ***C22C 38/00*** | (2006.01) |
| ***F25B 21/00*** | (2006.01) |
| ***H01F 1/00*** | (2006.01) |
| ***C22C 33/02*** | (2006.01) |
| ***B22F 5/00*** | (2006.01) |
| ***C22C 1/04*** | (2006.01) |
| ***B22F 3/14*** | (2006.01) |
| ***B22F 3/16*** | (2006.01) |
| ***C22C 33/04*** | (2006.01) |
| ***C22C 38/02*** | (2006.01) |
| ***H01F 1/03*** | (2006.01) |
| ***H01F 41/02*** | (2006.01) |
| *B22F 9/04* | (2006.01) |

(52) U.S. Cl.

CPC ..... *B22F 3/24* (2013.01); *B22F 3/14* (2013.01); *B22F 3/16* (2013.01); *B22F 5/00* (2013.01); *C22C 1/0441* (2013.01); *C22C 1/0483* (2013.01); *C22C 33/02* (2013.01); *C22C 33/04* (2013.01); *C22C 38/00* (2013.01); *C22C 38/005* (2013.01); *C22C 38/02* (2013.01); *C22C 38/04* (2013.01); *F25B 21/00* (2013.01); *H01F 1/00* (2013.01); *H01F 1/0306* (2013.01); *H01F 41/02* (2013.01); *B22F 9/04* (2013.01); *B22F 2301/355* (2013.01); *B22F 2998/10* (2013.01); *B22F 2999/00* (2013.01); *C22C 33/0257* (2013.01); *C22C 2202/02* (2013.01)

(58) Field of Classification Search
None
See application file for complete search history.

(56) References Cited

U.S. PATENT DOCUMENTS

| | | | |
|---|---|---|---|
| 2014/0023821 | A1 | 1/2014 | Kwon et al. |
| 2014/0127071 | A1 | 5/2014 | Fujinaka et al. |
| 2014/0341773 | A1 | 11/2014 | Fujinaka et al. |
| 2015/0037558 | A1 | 2/2015 | Dubrez et al. |
| 2015/0047371 | A1 | 2/2015 | Hu et al. |

FOREIGN PATENT DOCUMENTS

| | | | |
|---|---|---|---|
| EP | 2 804 187 | A1 | 11/2014 |
| JP | 2005-113209 | A | 4/2005 |
| JP | 2005-120391 | A | 5/2005 |
| JP | 2007-031831 | A | 2/2007 |
| JP | 2013-060639 | A | 4/2013 |
| JP | 2014-095486 | A | 5/2014 |

OTHER PUBLICATIONS

EPO English translation of JP2005-120391, translation dated Oct. 25, 2019 (Year: 2019).*

Krautz et al,I. A new type of La(Fe,Si)13-based magnetocaloric composite with amorphous metallic matrix, Oct. 18, 2004, Scripta Materialia 95 (2015) pp. 50-53 (Year: 2004).*

Zhang et al., Phase formation with NaZn13 structure in metamagnetic La(Fe1-xCox)11.9Si1.1 compounds, Oct. 2008, Journal of Rare Earths, vol. 26 p. 727 (Year: 2008).*

International Search Report of PCT/JP2016/056847 dated May 31, 2016.

International Preliminary Report on Patentability with a Translation of Written Opinion issued from the International Bureau in counterpart International Application No. PCT/JP2016/056847, dated Sep. 5, 2017.

European Patent Office; Communication dated Oct. 9, 2018 in counterpart application No. 16759042.1.

Lu, et al., "Correlation between average melting temperature and glass transition temperature in metallic glasses", Applied Physics Letters, Feb. 12, 2009, vol. 94, No. 6 (2 pages total).

(Continued)

*Primary Examiner* — Adam Krupicka
(74) *Attorney, Agent, or Firm* — Sughrue Mion, PLLC

(57) ABSTRACT

There is provided a method for producing a magnetic refrigeration module. The method comprises: a step (1) of preparing a mixture powder A containing an $La(Fe,Si)_{13}$-based alloy powder, an M powder, and optionally an organic binder, the $La(Fe,Si)_{13}$-based alloy powder having a main phase with an $NaZn_{13}$-type crystal structure, and the M powder containing a metal and/or an alloy and having a melting point of 1090° C. or lower; a step (2) of subjecting the mixture powder A to a heat treatment in a reducing atmosphere at a temperature close to the melting point of the M powder to obtain a sintered body B; and a step (3) of subjecting the sintered body B to a hydrogenation treatment in a hydrogen-containing atmosphere.

13 Claims, No Drawings

(56) References Cited

OTHER PUBLICATIONS

Mayer, et al., "Large scale PM Process for Producing Magnetocaloric Heat Exchanger", Powder Metallurgy for Current and Future Applications, Euro PM2015, France, 2015 (6 pages total).
Hirose Akio, "A Novel Bonding Process using Ag Nanoparticles-Application to Electronics Assembly as Alternative to Microsoldering using Lead-rich Solders—" Junction Technology and Journal of the Japan Welding Society, General Incorporated Foundation Japan Welding Society, Mar. 2007, vol. 76, No. 3, pp. 162-166 (11 pages total).

* cited by examiner

MANUFACTURING METHOD FOR MAGNETIC FREEZING MODULE

CROSS REFERENCE TO RELATED APPLICATIONS

This application is a National Stage of International Application No. PCT/JP2016/056847 filed Mar. 4, 2016, claiming priority based on Japanese Patent Application No. 2015-060129 filed Mar. 5, 2015, the contents of all of which are incorporated herein by reference in their entirety.

FIELD OF ART

The present invention relates to a method for producing a magnetic refrigeration module suitable for use in air conditioning equipments, household electric appliances such as freezers and refrigerators, vehicle air conditioners, and the like, and further relates to the magnetic refrigeration module.

BACKGROUND ART

Chlorofluorocarbon-type gases have been used as a cooling medium in an air conditioner, a freezer, and the like. However, the chlorofluorocarbon-type gas acts to harm the ozone layer and has an adverse effect on the environment disadvantageously.

Therefore, a magnetic refrigeration system has recently been proposed as a substitute for a conventional gas refrigeration system using the cooling medium of the chlorofluorocarbon-type gas having the environmental problem. The magnetic refrigeration system employs a magnetic refrigeration material as a refrigerant, and utilizes a magnetic entropy change, which occurs when the magnetic order of the material is changed by a magnetic field under an isothermal condition, and an adiabatic temperature change, which occurs when the magnetic order of the material is changed by a magnetic field under an adiabatic condition. Thus, the magnetic refrigeration system can achieve the refrigeration without using the chlorofluorocarbon gas, and has a higher refrigeration efficiency than that of the conventional gas refrigeration system advantageously.

In a practical use of the magnetic refrigeration material, it is necessary to form powder particles of the magnetic refrigeration material into a shape suitable for the refrigeration system to prepare a magnetic refrigeration module.

Patent Publication 1 discloses a method for producing a magnetic LaFeSiH material. In this method, magnetic particles are coated with a film of Sn or an Sn alloy, and then the particles are bonded to each other by a heat treatment at 100° C. to 300° C. in an inert gas atmosphere.

Patent Publication 2 discloses a method for producing a magnetic refrigeration material. In this method, an $La(Fe,Si)_{13}$ alloy powder is shaped by a spark plasma sintering process at a sintering temperature of 950° C. to 1200° C.

PRIOR ART PUBLICATIONS

Patent Publication 1: JP 2005-120391 A
Patent Publication 2: JP 2013-060639 A

SUMMARY OF THE INVENTION

Problem to be Solved by the Invention

However, in the method disclosed in Patent Publication 1, the magnetic refrigeration material is hydrogenated before the step of coating with the Sn or Sn alloy film. Thus, the particles of the $La(Fe,Si)_{13}$-based magnetic refrigeration material are hydrogenated and then coated with the Sn or Sn alloy film, and thereafter the particles are subjected to the heat treatment at 100° C. to 300° C. in the inert gas atmosphere. In this method, the hydrogenated material is subjected to the heat treatment again. Therefore, disadvantageously the material is dehydrogenated in the heat treatment, and the dehydrogenation makes it difficult to control the Curie temperature.

In the method disclosed in Patent Publication 2, the spark plasma sintering process is carried out at the high sintering temperature of 950° C. to 1200° C. Therefore, an $La(Fe,Si)_{13}$ phase, a main phase of the LaFeSi-based alloy, is decomposed, so that the content of the main phase is reduced, and the magnetic refrigeration performance and the material strength are lowered disadvantageously.

The present invention has been accomplished in view of solving the problems of the related art. An object of the present invention is to provide a method capable of preparing a sintered body at a low sintering temperature and producing a magnetic refrigeration module having a high material strength, a controlled Curie temperature, a high relative cooling power (abbreviated as RCP hereinafter), a large magnetic entropy change ($-\Delta S_M$), and an excellent magnetic refrigeration performance.

Another object of the present invention is to provide a magnetic refrigeration module having a high material strength, a controlled Curie temperature, a high RCP, a large magnetic entropy change ($-\Delta S_M$), and an excellent magnetic refrigeration performance.

Means for Solving the Problem

According to the present invention, there is provided a method for producing a magnetic refrigeration module containing an $La(Fe,Si)_{13}$-based magnetic refrigeration material having a main phase with an $NaZn_{13}$-type crystal structure (hereinafter occasionally referred to as the method of the present invention), the method comprising:

a step (1) of preparing a mixture powder A containing an $La(Fe,Si)_{13}$-based alloy powder and an M powder, the $La(Fe,Si)_{13}$-based alloy powder having a main phase with an $NaZn_{13}$-type crystal structure, and the M powder containing a metal and/or an alloy and having a melting point of 1090° C. or lower;

a step (2) of subjecting the mixture powder A to a sintering treatment in a reducing atmosphere at a temperature close to the melting point of the M powder to obtain a sintered body B; and a step (3) of subjecting the sintered body B to a hydrogenation treatment in a hydrogen-containing atmosphere.

According to the present invention, there is further provided a magnetic refrigeration module obtained by the above method.

Effect of the Invention

The method of the present invention is capable of preparing the sintered body at the low sintering temperature and producing the magnetic refrigeration module with a high material strength, a controlled Curie temperature, a high RCP, a large magnetic entropy change ($-\Delta S_M$), and an excellent magnetic refrigeration performance.

EMBODIMENTS OF THE INVENTION

The present invention will be described in more detail below.

The method of the present invention can be used for producing a magnetic refrigeration module containing an $La(Fe,Si)_{13}$-based alloy having a main phase with an $NaZn_{13}$-type crystal structure (hereinafter occasionally referred to simply as the $La(Fe,Si)_{13}$-based alloy). The method is a magnetic refrigeration module production method mainly containing the following steps (1) to (3).

In the step (1), a mixture powder A containing an $La(Fe,Si)_{13}$-based alloy powder and an M powder is prepared. The $La(Fe,Si)_{13}$-based alloy powder has a main phase with an $NaZn_{13}$-type crystal structure. The M powder contains a metal and/or an alloy and has a melting point of 1090° C. or lower. The mixture powder A may further contain an organic binder if necessary. In the step (1), the $La(Fe,Si)_{13}$-based alloy powder, the M powder, and optionally the organic binder may be mixed to prepare the mixture powder A.

Then, in the step (2), the mixture powder A prepared in the step (1) is subjected to a sintering treatment in a reducing atmosphere at a temperature close to the melting point of the M powder, to obtain a sintered body B.

In a case where the mixture powder A contains the organic binder in the step (1), the mixture powder A is preferably subjected to a de-binder treatment before the sintering treatment in the step (2).

Finally, in the step (3), the sintered body B obtained in the step (2) is subjected to a hydrogenation treatment in a hydrogen-containing atmosphere.

The $La(Fe,Si)_{13}$-based alloy powder used in the step (1) has a composition represented by the composition formula of $La_{1-a}RE_a(Fe_{1-b-c-d-e}Si_bMn_cX_dY_e)_{13}$. In the composition formula, RE stands for at least one element selected from the group consisting of rare earth elements other than La, X stands for at least one element selected from the group consisting of Al, Ga, Ge, Sn, and B, Y stands for at least one element selected from the group consisting of Ti, V, Cr, Co, Ni, Cu, Zn, and Zr, and a to e satisfy $0 \le a \le 0.50$, $0.03 \le b \le 0.17$, $0.003 \le c \le 0.06$, $0 \le d \le 0.025$, and $0 \le e \le 0.015$. In this description, the rare earth elements include scandium and yttrium.

The above composition formula reflects that La in the alloy may be partially substituted with RE. RE stands for at least one element selected from the group consisting of rare earth elements other than La. a represents the content of RE partially substituting La, and satisfies $0 \le a \le 0.50$. La and RE can act to control the Curie temperature and the RCP. When a is more than 0.50, the magnetic entropy change ($-\Delta S_M$) may be reduced.

In the composition formula, b represents the content of the Si element, and satisfies $0.03 \le b \le 0.17$. Si can act to control the Curie temperature and RCP. Furthermore, Si has effects of controlling the melting point of the alloy, increasing the mechanical strength, and the like. When b is less than 0.03, the Curie temperature is lowered. On the other hand, when b is more than 0.17, the magnetic entropy change ($-\Delta S_M$) may be reduced.

In the composition formula, c represents the content of the Mn element, and satisfies $0.003 \le c \le 0.06$. Mn is effective in controlling the Curie temperature or the magnetic entropy change ($-\Delta S_M$). When c is less than 0.003, it is difficult to control the Curie temperature. On the other hand, when c is more than 0.06, the magnetic entropy change ($-\Delta S_M$), measured and calculated under a magnetic field change of 2 tesla or less, may be reduced.

In the composition formula, d represents the content of the X element, and satisfies $0 \le d \le 0.025$. X stands for at least one element selected from the group consisting of Al, Ga, Ge, Sn, and B. X can act to control the Curie temperature and the RCP. Furthermore, X has effects of controlling the melting point of the alloy, increasing the mechanical strength, and the like. When d is more than 0.025, the magnetic entropy change ($-\Delta S_M$) may be reduced.

In the composition formula, e represents the content of the Y element, and satisfies $0 \le e \le 0.015$. Y stands for at least one element selected from the group consisting of Ti, V, Cr, Co, Ni, Cu, Zn, and Zr. Y can act to inhibit generation of an α-Fe phase, control the Curie temperature, and improve the durability of the powder. Incidentally, when the content of the Y element is outside the predetermined range, the amount of the compound phase with the $NaZn_{13}$-type crystal structure may be smaller than the desired amount to reduce the magnetic entropy change ($-\Delta S_M$).

The alloy may contain a trace amount of oxygen, nitrogen, and inevitable impurities derived from the raw material, although it is preferred that the amount thereof are as small as possible.

The average particle diameter (D50) of the $La(Fe,Si)_{13}$-based alloy powder having the main phase with the $NaZn_{13}$-type crystal structure is preferably not less than 3 μm and not more than 200 μm, further preferably not less than 3 μm and not more than 120 μm, although the preferred ranges depend on subsequent processes such as shaping and sintering. For example, the average particle diameter (D50) of the powder can be measured by a laser diffraction/scattering-type particle size distribution measuring apparatus MICROTRAC 3000 (product name) available from Nikkiso Co., Ltd.

A method for preparing the $La(Fe,Si)_{13}$-based alloy powder is not particularly limited, and may be a known method. Examples of the methods include melt quenching methods as typified by strip casting methods such as single-roll, twin-roll, and disc casting methods, atomization methods, arc melting methods, and mold casting methods. The cooling rate in the mold casting method is lower than that of the melt quenching method. In the mold casting method and the arc melting method, first, a raw material is prepared in view of the desired composition. Then, in an inert gas atmosphere, the prepared raw material is heat-melted to obtain a melt, the melt is cast into a water-cooling-type copper mold, and thus the melt is cooled and solidified to obtain an alloy ingot. In the roll quenching method and the atomization method, for example, the raw material is heat-melted in the same manner as above to obtain an alloy melt at a temperature at least 100° C. higher than the melting point. Then, the alloy melt is cast onto a water-cooling copper roll, or alternatively is quenched and solidified in a fine droplet state, to obtain an alloy flake.

The alloy ingot or the alloy flake, obtained by the cooling and solidifying, is subjected to a heat treatment for homogenization. The heat homogenization treatment is preferably carried out in an inert atmosphere at a temperature of not lower than 600° C. and not higher than 1250° C. The duration of the heat homogenization treatment is preferably not shorter than 10 minutes and not longer than 100 hours, more preferably not shorter than 10 minutes and not longer than 30 hours. When the temperature of the heat homogenization treatment is higher than 1250° C., a rare earth component on an alloy surface may be vaporized to cause shortage of the component, whereby the compound phase with the $NaZn_{13}$-type crystal structure may be decomposed. On the other hand, when the temperature of the heat homogenization treatment is lower than 600° C., the ratio of the compound phase with the $NaZn_{13}$-type crystal structure may not reach a desired value, and the ratio of the α-Fe phase may be increased in the alloy to reduce the magnetic entropy change ($-\Delta S_M$).

The alloy ingot or the alloy flake may be subjected to pulverization as required to obtain the desired average particle diameter (D50). The pulverization may be performed using a known method in view of the desired average particle diameter (D50). For example, the pulverization may be achieved by using a mechanical means such as a jaw crusher, a disk mill, an attritor, or a jet mill. Furthermore, the pulverization may be achieved by using a mortar or the like. The means for the pulverization is not limited thereto. The pulverized alloy may be screened after the pulverization to obtain the desired average particle diameter (D50) if necessary.

The M powder used in the step (1) contains a metal and/or an alloy and has a melting point of 1090° C. or lower. It is preferred that the M powder contains a metal and/or an alloy containing at least one element selected from the group consisting of Cu, Ag, Zn, Al, Ge, Sn, Sb, Pb, Ba, Bi, Ga, and In. A method for preparing the alloy is not particularly limited, and the alloy may be prepared by a known method in the same manner as the $La(Fe,Si)_{13}$-based alloy having the main phase with the $NaZn_{13}$-type crystal structure. The prepared alloy may be subjected to pulverization as required. Also the pulverization is not particularly limited, and the alloy may be pulverized by a known method in the same manner as the $La(Fe,Si)_{13}$-based alloy powder having the main phase with the $NaZn_{13}$-type crystal structure.

The M powder, which contains the metal and/or alloy and has a melting point of 1090° C. or lower, may be melted in the sintering treatment to be hereinafter described. The melted M powder acts as a binding agent for bonding the $La(Fe,Si)_{13}$-based alloy powder having the main phase with the $NaZn_{13}$-type crystal structure.

The average particle diameter (D50) of the M powder is preferably not less than 3 μm and not more than 200 μm, further preferably not less than 3 μm and not more than 120 μm, although the preferred ranges depend on subsequent processes such as shaping and sintering. The average particle diameter (D50) of the M powder can be measured in the same manner as the diameter of the $La(Fe,Si)_{13}$-based alloy powder having the main phase with the $NaZn_{13}$-type crystal structure.

In the step (1), the blend ratio between the $La(Fe,Si)_{13}$-based alloy powder and the M powder in the mixture powder A is not particularly limited. The volume ratio of the $La(Fe,Si)_{13}$-based alloy powder:the M powder is preferably 60%:40% to 99%:1%, further preferably 80%:20% to 97%:3%. When the ratio of the M powder is less than 1%, the M powder cannot be uniformly dispersed and bonded to the $La(Fe,Si)_{13}$-based alloy powder in many regions, so that the material strength after the sintering treatment is lowered disadvantageously. On the other hand, when the ratio of the M powder is more than 40%, the magnetic entropy change ($-\Delta S_M$) in the entire sintered body is reduced disadvantageously.

The mixture powder A containing the $La(Fe,Si)_{13}$-based alloy powder and the M powder is preferably in the form of a homogeneous mixture. The $La(Fe,Si)_{13}$-based alloy powder and the M powder may be mixed by a known method. For example, the $La(Fe,Si)_{13}$-based alloy powder and the M powder may be mixed while pulverizing a part of the powders by using a rotary mixer such as a double cone-type or V-type mixer, a stirring mixer such as a blade-type or screw-type mixer, or a pulverizer such as a ball mill or an attritor mill.

In the step (1), the mixture powder A may contain the organic binder as required. The organic binder may be a known binder, and examples thereof include epoxy resins, polyimide resins, PPS resins, and nylon resins. The organic binder is not particularly limited as long as it is capable of binding the mixture powder containing the $La(Fe,Si)_{13}$-based alloy powder and the M powder. The organic binder may be added to the mixture powder containing the $La(Fe,Si)_{13}$-based alloy powder and the M powder. Alternatively, the organic binder may be added before mixing the $La(Fe,Si)_{13}$-based alloy powder and the M powder, and the organic binder and the powders may be mixed together.

In a case where the mixture powder A contains the organic binder, the organic binder is removed from a shaped body of the mixture powder A (to be hereinafter described) before the sintering treatment at the temperature close to the melting point of the M powder in the step (2). This removal process is hereinafter referred to as the de-binder treatment. In the de-binder treatment, the shaped body of the mixture powder A is heated to a temperature, at which the organic binder is decomposed, to remove the organic binder. The organic binder can be decomposed and removed by heating at approximately 200° C. or higher, although the temperature depends on the type of the organic binder.

In the method of the present invention, the mixture powder A may be shaped to obtain the shaped body after the step (1). The mixture powder A may be shaped by a known method, and examples of the methods include molding, extrusion, injection, compression, and CIP (Cold Isostatic Pressing) methods. The shaping method is not particularly limited as long as it is capable of forming the mixture powder A into a desired shape.

In the method of the present invention, in the step (2), the mixture powder A or the shaped body prepared by shaping the mixture powder A in the above manner is subjected to the sintering treatment in the reducing atmosphere at a temperature close to the melting point of the M powder, to obtain the sintered body B. The temperature close to the melting point of the M powder may be higher or lower than the melting point. The sintering treatment is preferably carried out at a temperature within a range of the melting point−30° C. to the melting point+30° C. (i.e. at a temperature equal to, at most 30° C. higher than, or at most 30° C. lower than the melting point) for a period of not less than 5 minutes and not more than 50 hours. The sintering treatment is further preferably carried out at a temperature within a range of the melting point−20° C. to the melting point+10° C. for a period of not less than 10 minutes and not more than 30 hours. Since the sintering treatment is carried out at such a low temperature, the excellent structure of the $La(Fe,Si)_{13}$-based alloy powder can be maintained, and the decomposition of the main $La(Fe,Si)_{13}$ phase and the lowering of the material strength can be prevented. The sintering treatment may be carried out using a known method or equipment capable of atmospheric control. For example, the sintering treatment may be carried out using an atmosphere furnace, a hot press, HIP (Hot Isostatic Pressing), etc. The sintering treatment is not particularly limited as long as it is capable of preparing the desirable sintered body.

In the method of the present invention, in the step (3), the sintered body B obtained in the step (2) is subjected to the hydrogenation treatment in the hydrogen-containing atmosphere. In the hydrogenation, the sintered body B may be heat-treated in the hydrogen-containing atmosphere at a temperature of not lower than 100° C. and not higher than 450° C. for a period of not shorter than 10 minutes and not longer than 30 hours. The hydrogen-containing atmosphere in the hydrogenation treatment may be an atmosphere of a single hydrogen gas or a mixture gas containing hydrogen and Ar or the like. The hydrogenated magnetic refrigeration material can have a Curie temperature close to room temperature. By changing the hydrogen storage amount, the Curie temperature can be controlled, and the RCP can be increased. In a case where the hydrogenation treatment is carried out not in the final step but before the sintering treatment, the hydrogen stored in the material by the hydrogenation treatment may be removed in the sintering treatment to lower the Curie temperature disadvantageously. In a case where the hydrogenation treatment is carried out in the final step, the hydrogenated sintered body can be used as the magnetic refrigeration module without the adverse effect of the sintering treatment, i.e. without the dehydrogenation.

The density (%) of the sintered body B obtained in the method of the present invention is 85% or more, preferably 90% or more, further preferably 95% or more of the theoretical density. This density (%) is a relative density, i.e. a ratio of the measured density to the theoretical density.

In the present invention, the magnetic entropy change ($-\Delta S_M$) (J/kgK) is determined using a SQUID magnetometer VersaLab (product name, trademark) available from Quantum Design, Inc. The magnetization (magnetic susceptibility) can be measured under an applied magnetic field with constant intensity up to 2 tesla over a specific temperature range to obtain a magnetization-temperature curve, and the magnetic entropy change ($-\Delta S_M$) can be calculated from the magnetization-temperature curve using the following Maxwell equation:

$$\Delta S_M = \int_0^H \left(\frac{dM}{dT}\right)_H dH$$

wherein M represents a magnetization, T represents a temperature, and H represents an applied magnetic field.

Furthermore, the maximum ($-\Delta S_{max}$) of the magnetic entropy change ($-\Delta S_M$) can be obtained. The maximum ($-\Delta S_{max}$) is preferably 7.5 J/kgK or more, more preferably 10 J/kgK or more.

The RCP representing the magnetic refrigeration ability can be calculated as a product of the maximum ($-\Delta S_{max}$) of the magnetic entropy change ($-\Delta S_M$) and a half width in a temperature curve of the magnetic entropy change ($-\Delta S_M$) using the following equation:

$$RCP = -\Delta S_{max} \times \delta T$$

$-\Delta S_{max}$ represents the maximum of $-\Delta S_M$, and ST represents a half width of a $-\Delta S_M$ peak. The term "half width" used herein means a full width at half of the maximum ($-\Delta S_{max}$) in the temperature curve of the magnetic entropy change ($-\Delta S_M$), i.e. an index indicating a spread degree of a projecting peak curve with the maximum.

In the method of the present invention, the sintered body can be obtained with a controlled Curie temperature and a high RCP. The RCP of the sintered body is preferably 90 J/kg or more, more preferably 100 J/kg or more.

In the present invention, the material strength can be evaluated by judging whether the sintered body B can or cannot be cut-processed into a 0.3-mm-thick plate shape of the module.

EXAMPLES

The present invention will be described in more detail below with reference to Examples and Comparative Examples without intention of restricting the scope of the invention.

Example 1

The amounts of starting materials were determined in view of preparing an $La(Fe,Si)_{13}$-based alloy powder having a composition shown in Table 1. The starting materials were melted in an argon gas atmosphere by a high-frequency melting furnace to obtain an alloy melt. The alloy melt was cast at 1550° C., quenched, and solidified by a strip casting method using a water-cooling-type copper roll casting apparatus to obtain an alloy flake. The alloy flake had a composition of $La(Fe_{0.885}Si_{0.11}Mn_{0.005})_{13}$, determined by an ICP (Inductively Coupled Plasma) emission spectroscopic analysis. The alloy flake was maintained at 1080° C. for 20 hours in an argon gas atmosphere in a heat homogenization treatment, and then rapidly cooled to obtain an alloy flake having a main phase with an $NaZn_{13}$-type crystal structure. The alloy flake was pulverized in a nitrogen gas atmosphere by a disk mill to prepare the $La(Fe,Si)_{13}$-based alloy powder having an average particle diameter (D50) of 78 μm.

An Al powder having an average particle diameter (D50) of 65 μm was prepared as an M powder, and was mixed with the above prepared $La(Fe,Si)_{13}$-based alloy powder by a rotating/rocking mixer available from Aichi Electric Co., Ltd. to obtain a mixture powder A. The blend ratio of the $La(Fe,Si)_{13}$-based alloy powder:the Al powder was 96:4 by volume. The mixture powder A was formed under a pressure of 2.5 ton/cm$^2$ by a hydraulic molding apparatus into a rectangular shape with a size of 10 mm×10 mm×10 mm. The shaped body was subjected to a sintering treatment at 645° C. for 5 hours in an argon gas atmosphere to obtain a sintered body B. The temperature of 645° C. was 15° C. lower than the melting point 660° C. of Al. The compositions of the $La(Fe,Si)_{13}$-based alloy powder and the M powder, the blend ratio by volume, the melting point of the M powder, the sintering temperature, and the sintering time are shown in Table 1. The sintered body B had a density of 92%.

The sintered body B was subjected to a hydrogenation treatment under a hydrogen pressure of 0.2 MPa at 200° C. for 4 hours. It was confirmed that the hydrogenated sintered body could be cut-processed into a 0.3-mm-thick plate and had a satisfactory material strength. The hydrogenated sintered body was pulverized to obtain a powder. The magnetic entropy change ($-\Delta S_M$) of the powder was evaluated, and the maximum ($-\Delta S_{max}$) of the magnetic entropy change ($-\Delta S_M$) was calculated. The maximum ($-\Delta S_{max}$) of the magnetic entropy change ($-\Delta S_M$), the material strength, the Curie temperature, and the RCP measured are shown in Table 2. When a material could be cut-processed into a predetermined thickness and could maintain the shape, the material strength was evaluated as "A" in Table 2. When the shape was slightly deformed, the material strength was evaluated as "B". When a material could not be cut-processed into the predetermined thickness and could not maintain the shape, the material strength was evaluated as "C".

Example 2

A sintered body B was prepared in the same manner as Example 1 except that the composition of the $La(Fe,Si)_{13}$- based alloy powder, the composition of the M powder, the blend ratio of the $La(Fe,Si)_{13}$-based alloy powder and the M powder, the melting point of the M powder, the sintering temperature, and the sintering time were changed as shown in Table 1. The density, the maximum ($-\Delta S_{max}$) of the magnetic entropy change ($-\Delta S_M$), the material strength, the Curie temperature, and the RCP were measured in the same manner as Example 1. The results are shown in Table 2.

Example 3

A sintered body B was prepared in the same manner as Example 1 except that the blend ratio of the $La(Fe,Si)_{13}$-based alloy powder:the Al powder was 92:8, the mixture powder was mixed with an organic binder of a polyvinyl alcohol (PVA) to obtain a mixture powder A, the mixture powder A was shaped by an extrusion method, and then a de-binder treatment was carried out at 250° C. for 1 hour to obtain a shaped body. The density, the maximum ($-\Delta S_{max}$) of the magnetic entropy change ($-\Delta S_M$), the material strength, the Curie temperature, and the RCP were measured in the same manner as Example 1. The results are shown in Table 2.

Examples 4 to 14

Each sintered body B was prepared in the same manner as Example 1 except that the composition of the $La(Fe,Si)_{13}$-based alloy powder, the composition of the M powder, the blend ratio of the $La(Fe,Si)_{13}$-based alloy powder and the M powder, the melting point of the M powder, the sintering temperature, and the sintering time were changed as shown in Table 1. The density, the maximum ($-\Delta S_{max}$) of the magnetic entropy change ($-\Delta S_M$), the material strength, the Curie temperature, and the RCP were measured in the same manner as Example 1. The results are shown in Table 2.

Comparative Example 1

An $La(Fe,Si)_{13}$-based alloy powder having the same composition as Example 6 was prepared in the same manner as Example 1, and was subjected to a hydrogenation treatment in the same manner as Example 1. A surface of the $La(Fe,Si)_{13}$-based alloy powder was electrolytically plated with Sn. The weight ratio of the plated Sn to the $La(Fe,Si)_{13}$-based alloy powder was 8% by weight. A cross section of the particle was observed by an SEM after the Sn plating. As a result, the Sn plating was uniformly formed, and had an average Sn thickness of 1 μm. The Sn-plated $La(Fe,Si)_{13}$-based alloy powder was shaped in the same manner as Example 1, and the shaped body was subjected to a sintering treatment in an argon gas atmosphere at 210° C. for 5 hours to obtain a sintered body. The maximum ($-\Delta S_{max}$) of the magnetic entropy change ($-\Delta S_M$), the material strength, the Curie temperature, and the RCP were measured in the same manner as Example 1. The results are shown in Table 2.

Comparative Example 2

An $La(Fe,Si)_{13}$-based alloy powder having the same composition as Example 1 was subjected to a spark plasma sintering (SPS) process, to obtain a sintered body having the same shape as Example 1. The process was carried out under a surface pressure of 40 MPa at a sintering temperature of 1110° C. The maximum ($-\Delta S_{max}$) of the magnetic entropy change ($-\Delta S_M$), the material strength, the Curie temperature, and the RCP were measured in the same manner as Example 1. The results are shown in Table 2.

TABLE 1

| | Composition | | Blend ratio (by volume) | | Melting point | Sintering | Sintering | |
|---|---|---|---|---|---|---|---|---|
| | $La(Fe,Si)_{13}$-based alloy powder | M powder | $La(Fe,Si)_{13}$-based alloy powder | M powder | of M powder (° C.) | temperature (° C.) | time (hr) | Binder |
| Ex. 1 | $La(Fe_{0.885}Si_{0.11}Mn_{0.005})_{13}$ | Al | 96 | 4 | 660 | 645 | 5 | Not added |
| Ex. 2 | $La(Fe_{0.885}Si_{0.11}Mn_{0.005})_{13}$ | Al | 85 | 15 | 660 | 645 | 5 | Not added |
| Ex. 3 | $La(Fe_{0.885}Si_{0.11}Mn_{0.005})_{13}$ | Al | 92 | 8 | 660 | 645 | 5 | Added |
| Ex. 4 | $La(Fe_{0.88}Si_{0.11}Mn_{0.01})_{13}$ | Cu | 95 | 5 | 1084 | 1060 | 10 | Not added |
| Ex. 5 | $La(Fe_{0.88}Si_{0.11}Mn_{0.01})_{13}$ | Zn | 95 | 5 | 420 | 400 | 10 | Not added |
| Ex. 6 | $La(Fe_{0.88}Si_{0.10}Mn_{0.02})_{13}$ | $Al_{48}Cu_{52}$ | 94 | 6 | 595 | 575 | 10 | Not added |
| Ex. 7 | $La(Fe_{0.88}Si_{0.10}Mn_{0.02})_{13}$ | Al | 83 | 17 | 660 | 645 | 5 | Not added |
| Ex. 8 | $La(Fe_{0.885}Si_{0.11}Mn_{0.005})_{13}$ | Al | 70 | 30 | 660 | 645 | 5 | Not added |
| Ex. 9 | $La(Fe_{0.88}Si_{0.10}Mn_{0.02})_{13}$ | Al | 99.5 | 0.5 | 660 | 645 | 5 | Not added |
| Ex. 10 | $La(Fe_{0.88}Si_{0.10}Mn_{0.02})_{13}$ | Al | 58 | 42 | 660 | 645 | 5 | Not added |
| Ex. 11 | $La(Fe_{0.885}Si_{0.11}Mn_{0.005})_{13}$ | Al | 96 | 4 | 660 | 660 | 5 | Not added |
| Ex. 12 | $La(Fe_{0.885}Si_{0.11}Mn_{0.005})_{13}$ | Al | 96 | 4 | 660 | 690 | 5 | Not added |
| Ex. 13 | $La(Fe_{0.885}Si_{0.11}Mn_{0.005})_{13}$ | Al | 96 | 4 | 660 | 670 | 5 | Not added |
| Ex. 14 | $La(Fe_{0.885}Si_{0.11}Mn_{0.005})_{13}$ | Al | 96 | 4 | 660 | 630 | 5 | Not added |
| Comp. Ex. 1 | $La(Fe_{0.88}Si_{0.10}Mn_{0.02})_{13}$ | Sn plating | Ratio of Sn to alloy powder being 8% by weight | | — | 210 | 5 | Not added |
| Comp. Ex. 2 | $La(Fe_{0.885}Si_{0.11}Mn_{0.005})_{13}$ | — | 100 | 0 | — | 1100 | — | Not added |

TABLE 2

| | Density (%) | Maximum ($-\Delta S_{max}$) of magnetic entropy change (J/kgK) | Material strength | Curie temperature (° C.) | RCP (J/kg) |
|---|---|---|---|---|---|
| Ex. 1 | 92 | 17.6 | A | 55 | 176 |
| Ex. 2 | 97 | 13.8 | A | 53 | 128 |
| Ex. 3 | 94 | 15.6 | A | 56 | 145 |
| Ex. 4 | 93 | 16.7 | A | 45 | 180 |
| Ex. 5 | 93 | 16.1 | A | 43 | 161 |
| Ex. 6 | 94 | 15.7 | A | 28 | 170 |
| Ex. 7 | 97 | 12.4 | A | 26 | 125 |
| Ex. 8 | 98 | 12.1 | A | 54 | 123 |
| Ex. 9 | 85 | 19.2 | B | 28 | 171 |
| Ex. 10 | 99 | 8.1 | A | 26 | 90 |
| Ex. 11 | 97 | 17.5 | A | 54 | 175 |

TABLE 2-continued

| | Density (%) | Maximum ($-\Delta S_{max}$) of magnetic entropy change (J/kgK) | Material strength | Curie temperature (° C.) | RCP (J/kg) |
|---|---|---|---|---|---|
| Ex. 12 | 99 | 17.2 | A | 55 | 175 |
| Ex. 13 | 98 | 17.4 | A | 56 | 172 |
| Ex. 14 | 88 | 17.1 | A | 53 | 171 |
| Comp. Ex. 1 | 88 | 11.4 | C | 25 | 112 |
| Comp. Ex. 2 | 92 | 6.9 | A | 38 | 85 |

What is claimed is:

1. A method for producing a magnetic refrigeration module, comprising:

step (1) of preparing a mixture powder A containing an $La(Fe,Si)_{13}$-based alloy powder and an M powder, the $La(Fe,Si)_{13}$-based alloy powder having a main phase with an $NaZn_{13}$-type crystal structure, and the M powder containing a metal and/or an alloy and having a melting point of 1090° C. or lower;

step (2) of subjecting the mixture powder A to a sintering treatment in a reducing atmosphere at a temperature close to the melting point of the M powder to obtain a sintered body B, wherein the volume ratio of the $La(Fe,Si)_{13}$-based alloy powder:the M powder is 80%:20% to 97%:3%; and step (3) of subjecting the sintered body B to a hydrogenation treatment in a hydrogen-containing atmosphere.

2. The method according to claim 1, wherein the mixture powder A is shaped to obtain a shaped body before the sintering treatment in the step (2).

3. The method according to claim 2, wherein the mixture powder A is shaped by molding, CIP, injection, extrusion, or compression in the step (2).

4. The method according to claim 1, wherein the sintering treatment is carried out by a method using an atmosphere furnace, a hot press, or HIP in the step (2).

5. The method according to claim 1, wherein the mixture powder A contains an organic binder.

6. The method according to claim 5, wherein the mixture powder A is subjected to a de-binder treatment in the step (1) before the sintering treatment in the step (2).

7. The method according to claim 1, wherein the M powder having a melting point of 1090° C. or lower contains a metal and/or an alloy containing at least one element selected from the group consisting of Cu, Ag, Zn, Al, Ge, Sn, Sb, Pb, Ba, Bi, Ga, and In.

8. A magnetic refrigeration module obtained by the method according to claim 1.

9. A sintered body comprising an $La(Fe,Si)_{13}$-based alloy and a component M, wherein the $La(Fe,Si)_{13}$-based alloy has a main phase with an $NaZn_{13}$-type crystal structure, the component M contains a metal and/or an alloy and has a melting point of 1090° C. or lower, and the sintered body is obtained by sintering a powder of the $La(Fe,Si)_{13}$-based alloy and a powder of the component M at a temperature close to the melting point of the component M, the volume ratio of the $La(Fe,Si)_{13}$-based alloy powder:the M powder being 80%:20% to 97%:3%.

10. The sintered body according to claim 9, consisting of the $La(Fe,Si)_{13}$-based alloy and the component M.

11. The sintered body according to claim 9, wherein the powder of the $La(Fe,Si)_{13}$-based alloy is bonded by the component M.

12. The sintered body according to claim 9, wherein the $La(Fe,Si)_{13}$-based alloy has a composition represented by the following composition formula:

$$La_{1-a}RE_a(Fe_{1-b-c-d-e}Si_bMn_cX_dY_e)_{13}$$

wherein RE stands for at least one element selected from the group consisting of rare earth elements other than La, X stands for at least one element selected from the group consisting of Al, Ga, Ge, Sn, and B, Y stands for at least one element selected from the group consisting of Ti, V, Cr, Co, Ni, Cu, Zn, and Zr, and a to e satisfy $0 \le a \le 0.50$, $0.03 \le b \le 0.17$, $0.003 \le c \le 0.06$, $0 \le d \le 0.025$, and $0 \le e \le 0.015$, and wherein the component M contains a metal and/or an alloy containing at least one element selected from the group consisting of Cu, Ag, Zn, Al, Ge, Sn, Sb, Pb, Ba, Bi, Ga, and In.

13. A magnetic refrigeration module obtained by hydrogenating the sintered body according to claim 9.

* * * * *